United States Patent [19]

Weber

[11] 4,306,271

[45] Dec. 15, 1981

[54] SEQUENTIALLY PULSED OVERLAPPING FIELD MULTIELECTRODE CORONA CHARGING METHOD AND APPARATUS

[75] Inventor: Harold J. Weber, Sherborn, Mass.

[73] Assignee: Coulter Systems Corporation, Bedford, Mass.

[21] Appl. No.: 190,363

[22] Filed: Sep. 24, 1980

[51] Int. Cl.[3] ..... H01T 19/00

[52] U.S. Cl. ..... 361/229; 361/235; 355/3 CH; 250/325

[58] Field of Search ..... 361/230, 235, 229, 225; 355/3 CH; 250/325, 326

[56] References Cited

U.S. PATENT DOCUMENTS 3,978,380 8/1976 Talmage ..... 361/229
4,166,690 9/1979 Bacon et al. ..... 355/3 CH
4,240,125 12/1980 Kuehnle ..... 361/230
4,245,272 12/1980 Rushing et al. ..... 361/229

*Primary Examiner*—Patrick R. Salce
*Assistant Examiner*—L. C. Schroeder

[57] ABSTRACT

A sequential corona charging method including apparatus therefor which acts to provide several corona fields, each of its own distinct origin, which are brought together with some spatial overlap to act collectively to provide uniform charge current distribution throughout the surface of an electrophotographic medium. Independence from non-uniform charging brought about by the undesirable effects of electrostatic repulsion between adjacent electric corona fields is achieved through the rapid controlled on and off sequencing of overlapping field corona regions so that the active time coincident therebetween is negligible.

33 Claims, 10 Drawing Figures

SEQUENTIALLY PULSED OVERLAPPING FIELD MULTIELECTRODE CORONA CHARGING METHOD AND APPARATUS

SUMMARY

The charging of electrophotographic material is normally accomplished by producing a corona discharge between an electrode suspended near the surface of the medium and the surface. The resulting ionization of the surrounding air produces a d.c. current flow which results in an accumulated electric charge on the electrophotographic medium. The result is a temporary electrostatic charge on the electrophotographic image receptor which is light sensitive and may therefore be discharged in accord with an image pattern, subsequently toned, and act to produce an image reproduction of the pattern.

Certain types of electrophotographic materials have particular advantageous adaptability for continuous tone, "photographic-like" imagery. In particular, film such as that made in accord with U.S. Pat. No. 4,025,339 "Electrophotographic Film, Method of Making the Same and Photoconductive Coating Used Therewith" exhibits a broad tonal scale. Such electrophotographic materials must be uniformly charged in order to take advantage of the inherent range in tonal scale. Therefore, many charging devices have been developed over the years which attempt to improve charge uniformity performance. The use of two or more corona electrodes in near juxtaposition is advantageous to assure more even charging. For example, two, or more, corona producing wires may be parallel strung. In particular, such multiple wire arrangement may serve to reduce the deleterious effect of corona beads or "hot spots" on the usual wire which are wrought by minor manufacturing flaws in the wire, dirt, and irregular electric field distributions. Multiple corona wires also produce an electrostatic repulsion between adjacent, overlapping corona fields. This results in a less than optimum charge uniformity upon the charge receptor surface. In practice, the corona field electrostatic violation may be of such consequence as to negate any advantage which may otherwise be reasonable to gain by using a plurality of corona wires.

Therefore, a purpose of the instant invention is to show a method whereby the advantages of enhanced uniformity for charge distribution which may be expected to be produced by multiple wire coronas may be had without the drawbacks associated with electrostatic repulsion between adjacent corona fields.

Yet another purpose of the invention is to teach the rapid sequential scanning of a multiplicity of corona electrodes. The result is that the total effective corona field produced between a number of juxtaposed corona electrodes, and most particularly corona wires, is a blur of contiguous corona fields which appear to virtually blanket a substantial portion of the nearby charge receptor surface.

Still another purpose is to provide a rapidly recurring sequence of individual corona fields each originating from one of several field proximate corona electrodes, whereby the overall effect is that of a pseudo-continuum of total electric corona field impinging upon the charge receptor surface.

A vital purpose of the instant invention is to show means adapted to eliminating the nonuniformities associated with a corona field having a plurality of corona electrodes which is brought forth by electrostatic repulsion between adjacent corona fields.

Therefore, the overall essence of the invention is at least to teach the efficient charging of an electrophotographic medium by a corona producing source which operates with a multiplicity of parallel corona wires.

BACKGROUND OF THE INVENTION

The generation of a uniform corona field is vital for accomplishing the fullest utility of many modern electrophotographic mediums. Conventional corona charging includes corona electrode assemblies in the form of a fine wire suspended over the chargeable surface which is commonly plagued with performance nonuniformities. Most pronounced of these nonuniformities is the presence of "beads" or hot spots on the corona wire. These beads appear as points, on the wire, having increased current concentration, and are believed to be wrought by not only physical flaws in the wire surface, but also by irregular electric field concentrations. Therefore, it became clear sometime ago that impovement could be had, at least insofar as apparent net surface charge effect is concerned, if these beads could be moved about relative to the surface while the charging action is going on. In particular, Rosenthal describes apparatus which can perform such movement in U.S. Pat. No. 2,856,533 "Moving Wire Corona." The wire moves axially as a continuous, endless loop in one form; in another form it rotates about its axis; whilst in yet another form it oscillates to and fro along its axis. In each case the beads which may form are "blurred" and thus made to substantially disappear insofar as their effect on the success of good charge acceptance uniformity by the receptor member is concerned. Giaimo in U.S. Pat. No. 2,956,487 "Electrostatic Printing" gives illustration of a stationary multiwire corona 27 which may set together in plurality to offset some of the charge negating effects produced by any given orientation of heads on a lone wire. Jarvis in U.S. Pat. No. 3,233,156 "Electrostatic Charging Methods and Apparatus" shows a rotating wire wound as a spiral which can serve to sweep across a photoconductor surface. Also depicted is a rotating helix of discs, and a rotating "brush" arrangement of needle like electrodes. In each of these cases, mechanical rotation is believed to enhance the laid-down charge uniformity through bead dispersion, etc.

In each of the teachings of Rosenthal and Jarvis complex and difficult to fabricate and maintain mechanical devices are relied upon to resolve what is effectually an electric problem. With more sensitive photoconductor materials and improved imaging agents, it must be recognized that even the cyclic mechanical patterns set up by these earlier devices can be disturbing.

Giaimo does not introduce motion into the corona electrode structure. Rather he seeks charge distribution uniformity by providing several parallel corona electrodes. This introduces the alternative nonuniformities produced by electrostatic repulsion between the overlapping like-polarity corona fields. The attendant field nonuniformities offset any advantages sought by multiwire corona arrangements when working with sensitive electrophotographic materials.

Therefore, in view of these earlier approaches, the alert artisian will quickly realize that the manipulation of the electric fields, i.e., the sequential scanning of a number of corona electrodes, as herein taught can produce an effective corona "blanket," a continuous acting corona region, which has an average charging effect on a charge receptor (photoconductor) surface oriented adjacently which is of maximally uniform value. Furthermore, the artisian will appreciate that no mechanical esoterica is employed to attain the desired results, thereby enhancing the overall life expectancy of a using machine and generally reducing the cost to produce the machine.

DESCRIPTION OF DRAWINGS

Six sheets of drawings including ten figures depict the invention.

DESCRIPTION OF INVENTION

Figure 1:
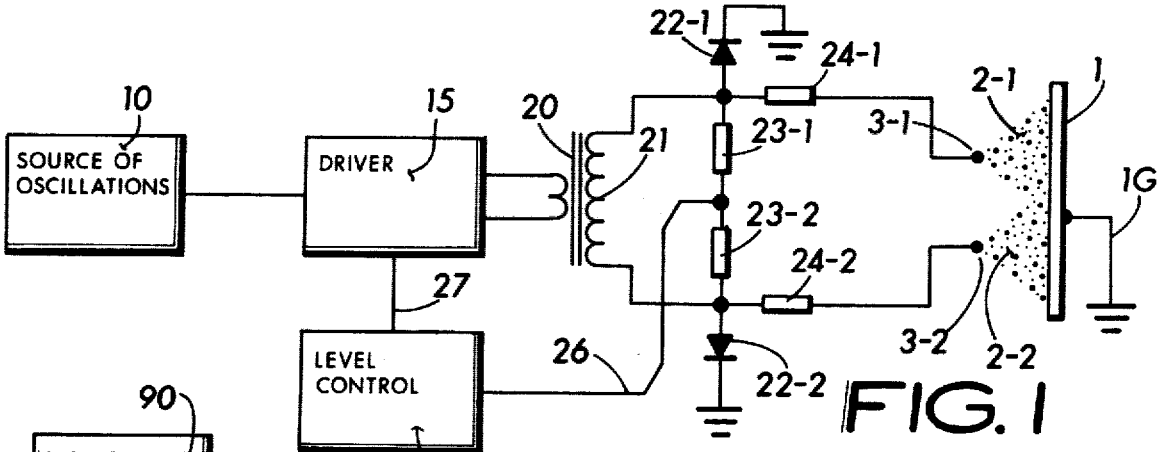
FIG. 1 Essential view of alternating corona fields.

The gist of the invention is depicted in FIG. 1. A charge receptor 1, which usually couples to ground 1G is "sprayed" with corona discharge fields 2-1, 2-2 originating substantially from two corona electrodes 3-1, 3-2. The resulting fields are produced by the presence of a high voltage: usually on the order of 5,000 to 10,000 volts, established between the corona electrodes and the receptor. In the example, a source of oscillations 10 produces a train of repetative pulses which couple by way of an amplifying driver 15 to a step-up transformer 20. The transformer secondary 21 is capable of producing a high voltage pulse value which is alternately steered to one or the other corona electrodes. In the shown hookup, when the transformer secondary presents a positive pulse to diode 22-2, that end of the secondary is effectively grounded through the forward conduction of the diode. At the same instant, a high negative value will appear at the winding end connected with diode 22-1, the diode being therewith back biased. This high voltage connects through a current limiting resistor 24-1 to electrode 3-1, which acts to produce corona field 2-1. When the transformer secondary phase reverses which is the usual effect wrought by the second half of an a.c. excitation cycle, a positive pulse appears on that end of the secondary coupled with diode 22-1 which serves to couple the pulse to ground. This action also stops any further corona associated with electrode 3-1, because the effective voltage is about zero. At the same instant a high negative voltage pulse appears across reverse biased diode 22-2, producing a high corona voltage on electrode 3-2 through limiting resistor 24-2. A second corona field 2-2 is thus produced. What ensues is a back and forth, noncoincident excitation of the two fields 2-1, 2-2 in rapid sequentiality. The apparent, useful effect produced on the charge receptor is that of a virtual continuous excitation of the entire charge receptor surface.

The resistors 23-1, 23-2 join to produce a pulsing negative voltage at their juncture 26 which is integrated to act with a level control 25 to provide regulation of the d.c. power source 90 electric power 91 coupled therethrough 27 to the driver.

Figure 2:
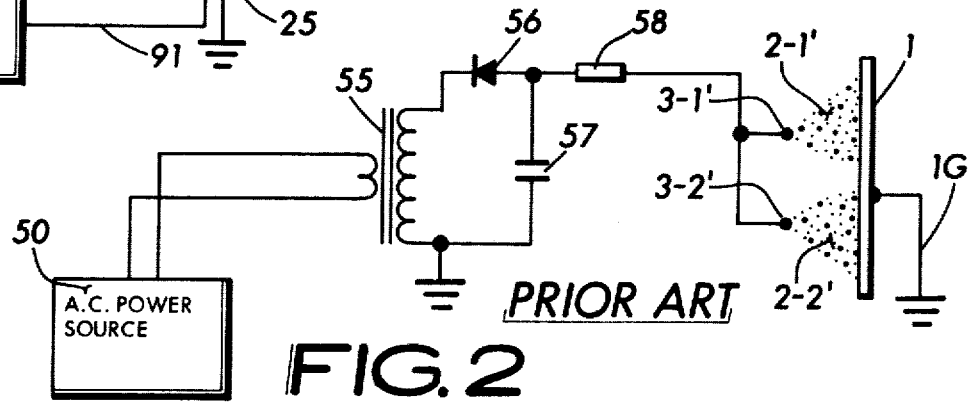
FIG. 2 Prior art view showing how adjacent parallel corona fields repulse.

The usual prior art connection for plural corona electrodes is depicted in FIG. 2. Again, the charge receptor 1 is shown associated with two corona electrodes 3-1', 3-2' acting to produce fields 2-1', 2-2' when a predetermined potential is applied. An a.c. power source 50 (such as the utility power mains, etc.) couples with a step-up transformer 55. Rectifier 56 steers negative charge to capacitor 57. The accumulated charge couples through a current limiting resistor 58 to the two parallel connected corona electrodes. Again, voltages on the order of 5,000 to 10,000 volts are typical, with usual currents of 0.05 to about 3 milliamperes.

The detrimental effect of electrostatic repulsion of the like-charged corona fields is clearly shown. Observing field 2-1', note that the edge of the field 2-1 normally expected to abut or overlap field 2-2 does not extend straight thereto, but rather the fields (for that matter both fields) show a "bending" of each individual field edge, depicted in the drawing as a slight curvature, although the actual repulsed field lines may assume some other alteration. The fact remains that the net effect at the charge receptor surface is the same as though the lines bend as they are shown, therefore not reaching the geometrically cobounding area with good efficiency. The result is a less than optimum, e.g. uneven, charge coupling with the midpoint of the charge receptor 1. The overlap of adjacent fields is desirous, however, to provide more even electrical illumination of, or average unit area charge current flow into, the charge receptor which is commonly an electrophotographic medium requiring a uniform overall charge in order to attain good quality imaging.

Figure 3:
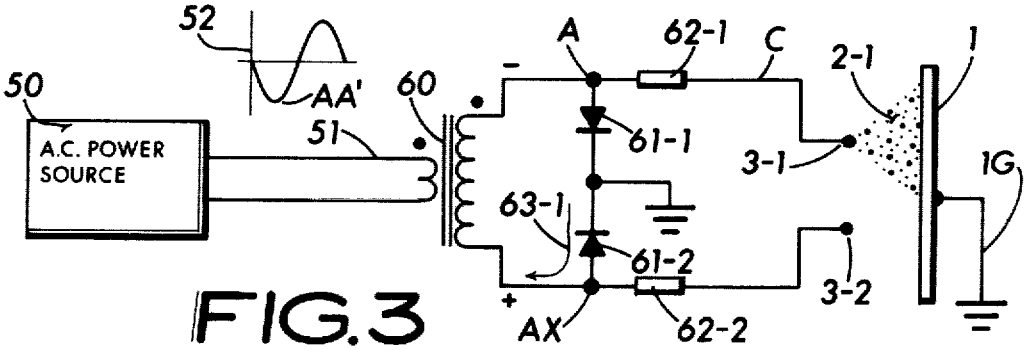
FIG. 3 Detail of FIG. 1 operation on first power half cycle.
Figure 4:
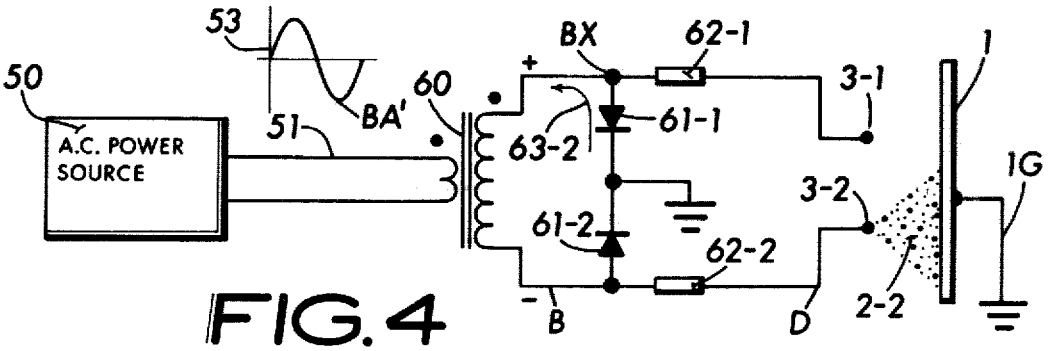
FIG. 4 Detail of FIG. 1 operation on second power half cycle.
Figure 5:
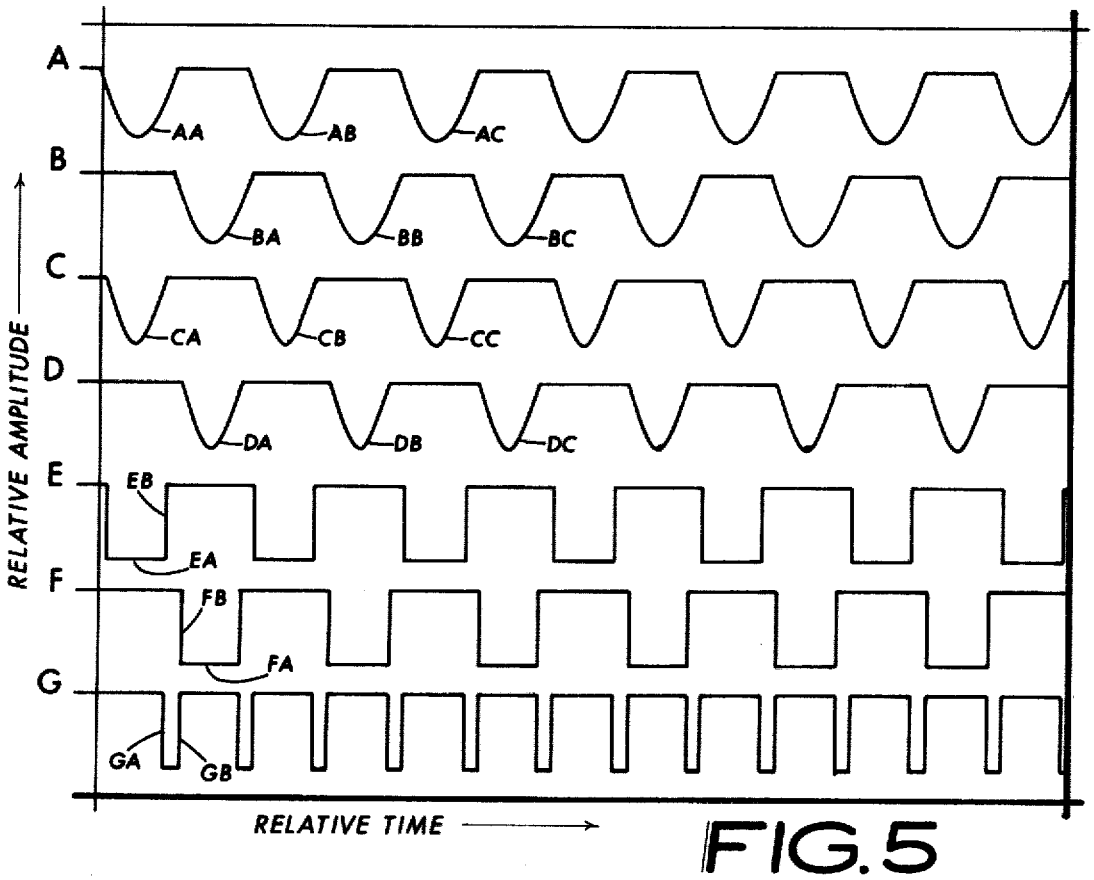
FIG. 5 Waveforms associated with FIG. 3 and FIG. 4.

The FIGS. 3, 4 and 5 serve to particularly illustrate the coaction between the separate corona fields and, most particularly, the relaxation period between alternate corona discharges. FIG. 3 shows a source of a.c. power 50, i.e., the 60 (or 50) hertz utility power coupled 51 with a step-up transformer 60. The waveform AA' graphically shown 52 and also in FIG. 5 provides the desired negative half cycle which translates through the transformer 60 to produce a like negative high voltage pulse at juncture A. At the same time juncture AX appears positive and is effectively grounded through diode 61-2. The high negative voltage couples through a current limiting resistor 62-1 to the corona electrode 3-1. Corona field 2-1 results. Alternatively, in FIG. 4 when the phase, or polarity sense, of waveform 53 reverses BA', juncture BX appears positive and grounds through diode 61-1 forward conduction, whereas juncture B goes to a high negative level, coupling through current limiting resistor 62-2 to corona electrode 3-2. Corona field 2-2 results. Due to the sloped risetime of the individual waveforms A and B in FIG. 5, as associated with FIGS. 3 and 4, current flow through the corona field is not immediate during each half cycle. The corona field commences only after some finite time when the electric potential produced by the transformer secondary through either current limiting resistor 62-1, 62-2 reaches a level sufficiently high to start and subsequently sustain a corona discharge 2-1 or 2-2. This purposeful delay of current flow is depicted by waveforms C and D where it can be seen that corona current pulses CA, CB, CC are somewhat narrower than corresponding voltage pulses AA, AB, AC. In a like way, current pulses DA, DB, DC are narrower, or of briefer duration, than corresponding voltage pulses BA, BB, BC. The effective corona field time is shown as E for, say, corona field 2-1, and F for, say, corona field 2-2. The duration EA or FA corresponds with the respective pulse periods CA, DA. The result is the difference between the pulse edge EB and edge FB results in a pulse G having corresponding edges GA, GB. The effective duration of pulse G found between edges GA and GB is the overall interpulse corona field relaxation time.

The relaxation time is desired and therefore predetermined to allow the electrostatic fields associated with one corona field to dissipate before the second successive corona field initiates. This relaxation is believed to minimize the parasitic effects of interfield repulsion due to residual electrostatic potentials. With the practiced system, the inherent interpulse relaxation time G is inherently on the order of one millisecond.

Figure 6:
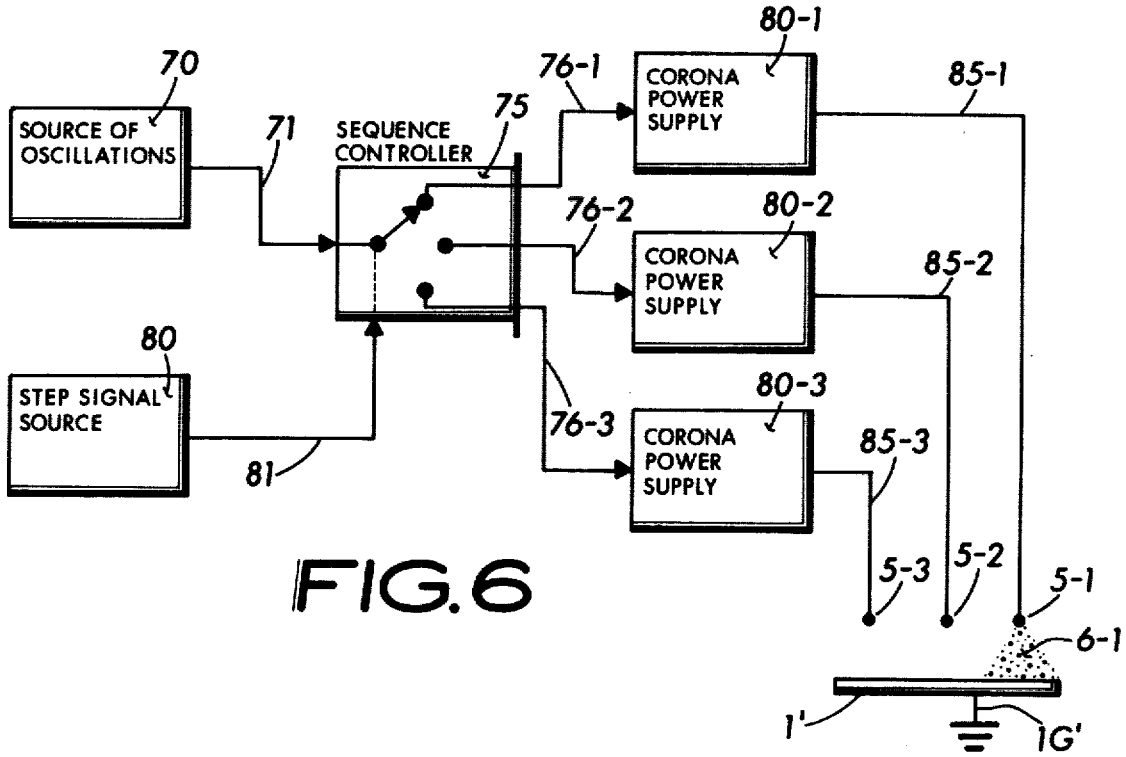
FIG. 6 Functional diagram for sequential scanning of several corona electrodes.

A further improvement, teaching the use of more than two field overlapping coronas, is shown in FIG. 6. A source of high frequency alternating current oscillations 70 (on the order of 5 kilohertz) couples 71 with a sequence controller 75. The controller is advanced by a low frequency step signal source 80 coupled 81 with the sequencing function. The low frequency (say about 25 hertz) stepping action sequences the high frequency oscillations serially, one at a time, between any one of three or more corona power supply functions 80-1, 80-2, 80-3 via lines 76-1, 76-2, 76-3. The result is a one-at-a-time repetitive sequence of corona high voltage potentials on output lines 85-1, 85-2, 85-3 which couple with corresponding coronas 5-1, 5-2, 5-3. The produced effect is a cascade of corona fields, typified as 6-1, which sequence from electrode 5-1 to 5-2- to 5-3, then repeat. The corona fields appear to "sweep" across the charge receptor 1' surface although no mechanical motion is involved. Each separate corona field 6-1 emanating from one of the electrodes 5-1, 5-2, 5-3 may spatially overlap either or both of the other fields, but they are separate and distinct in time therefore negating the deleterious effects of electrostatic repulsion therebetween.

Figure 7:
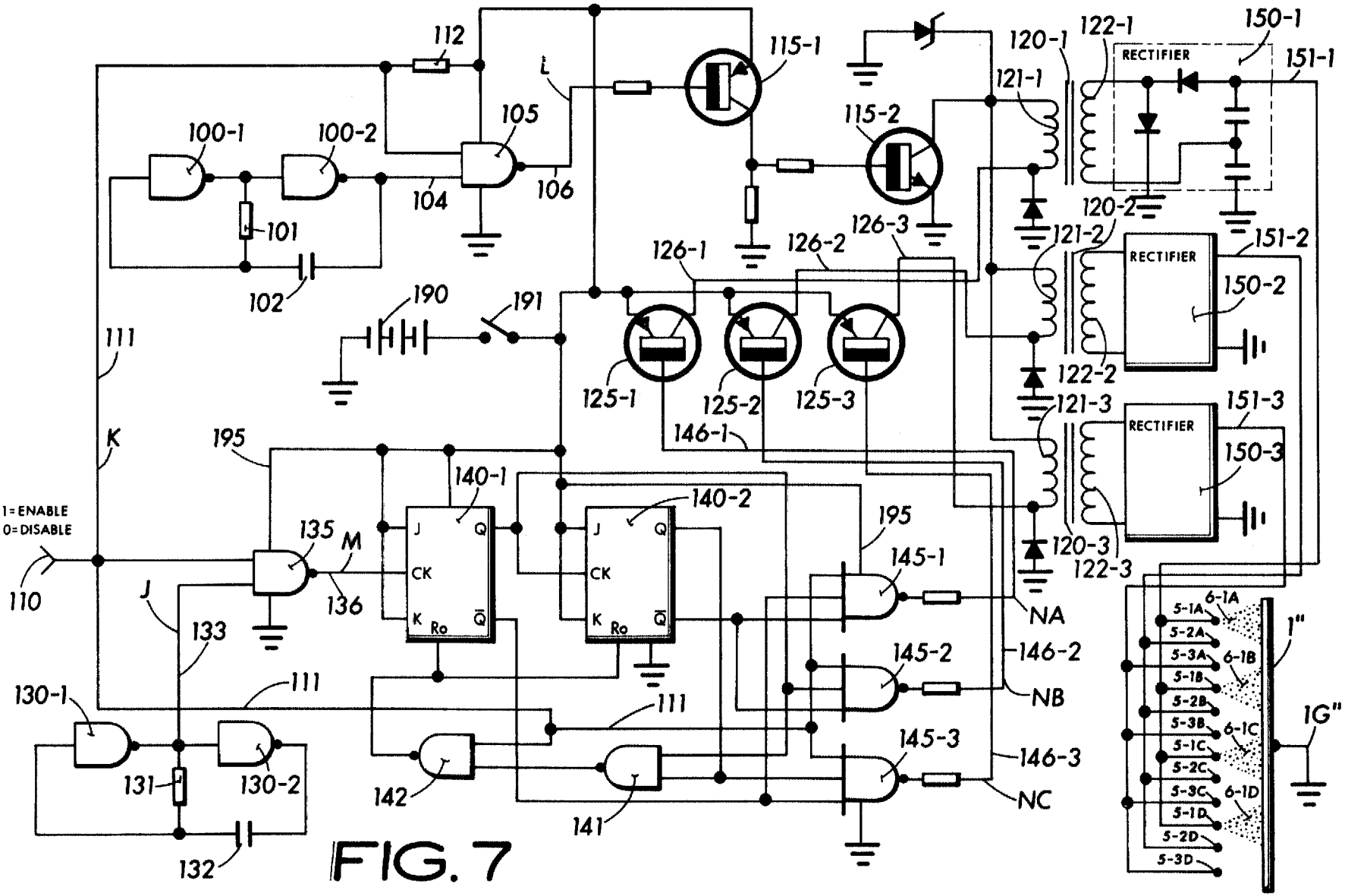
FIG. 7 Electrical diagram for a preferred embodiment scanning three groups of juxtaposed corona electrodes.

The electrical diagram for a preferred embodiment of the invention, having the sequential scanning or "sweeping" action of FIG. 6 is shown in FIG. 7. The high frequency oscillator comprises a multivibrator including inverters (say C-MOS type CD4069) 100-1, 100-2 together with timing components 101, 102. The output 104 couples with NAND gate 105, having another input 111 enabled by a logic 1 level produced by pull-up resistor 112. The resulting oscillations 106 from the gate couple with PNP transistor 115-1 which serves to current drive the base of NPN transistor 115-2. The collector of the power transistor 115-2 is commonly tied to one end of each of the transformer primaries 121-1, 121-2, 121-3.

The sequencing oscillator includes a multivibrator made up of C-MOS inverters 130-1, 130-2 together with timing elements 131, 132. The J signal on line 133 couples with an otherwise enabled NAND gate 135, producing a clock signal 136 for the "divide by three" counter including J-K flipflops 140-1, 140-2 and NAND gates 141, 142. NAND gates 145-1, 145-2, 145-3 principally serve to DECODE the counter binary states into one-of-three outputs 146-1, 146-2, 146-3 in seriation. The three outputs couple to PNP transistors 125-1, 125-2, 125-3. The three transistors act as sequential switches step-wise coupling the electric potential 195 to the respective transformer primaries 121-1, 121-2, 121-3 ad infinitum. As each transformer primary circuit momentarily completes, high frequency oscillations will be induced therein which will cause each transformer 120-1, 120-2, 120-3 to produce a high voltage in the associated secondary 122-1, 122-2, 122-3. This high voltage is rectified by the rectifier arrangement 150-1, 150-2, 150-3 which may include voltage multiplier means. The resulting, one-at-a-time, high voltage outputs 151-1, 151-2, 151-3 couple to a serial arrangement of many corona electrodes facing a charge receptor 1" coupled to ground 1G". The corona electrode arrangement shown in the example includes four groups, each group comprising three corona electrodes. The first group, including electrodes 5-1A, 5-2A, 5-3A produces corona field 6-1A which "sweeps" sequentially between the three electrodes. This moving field collects on a part of the charge receptor 1" which couples to ground 1G". In a like way, the second electrode group 5-1B, 5-2B, 5-3B produces the moving field 6-1B. The third electrode group 5-1C, 5-2C, 5-3C serves to produce the moving field 6-1C and the fourth electrode group 5-1D, 5-2D, 5-3D serves to produce the moving field 6-1D. The intercoupling of the high voltage is shown to produce a non-overlapping corona field sweeping action which combinatively coact to uniformly charge the charge receptor without the nonuniformities associated with electrostatic repulsion between adjacent multiple corona fields.

Figure 8:
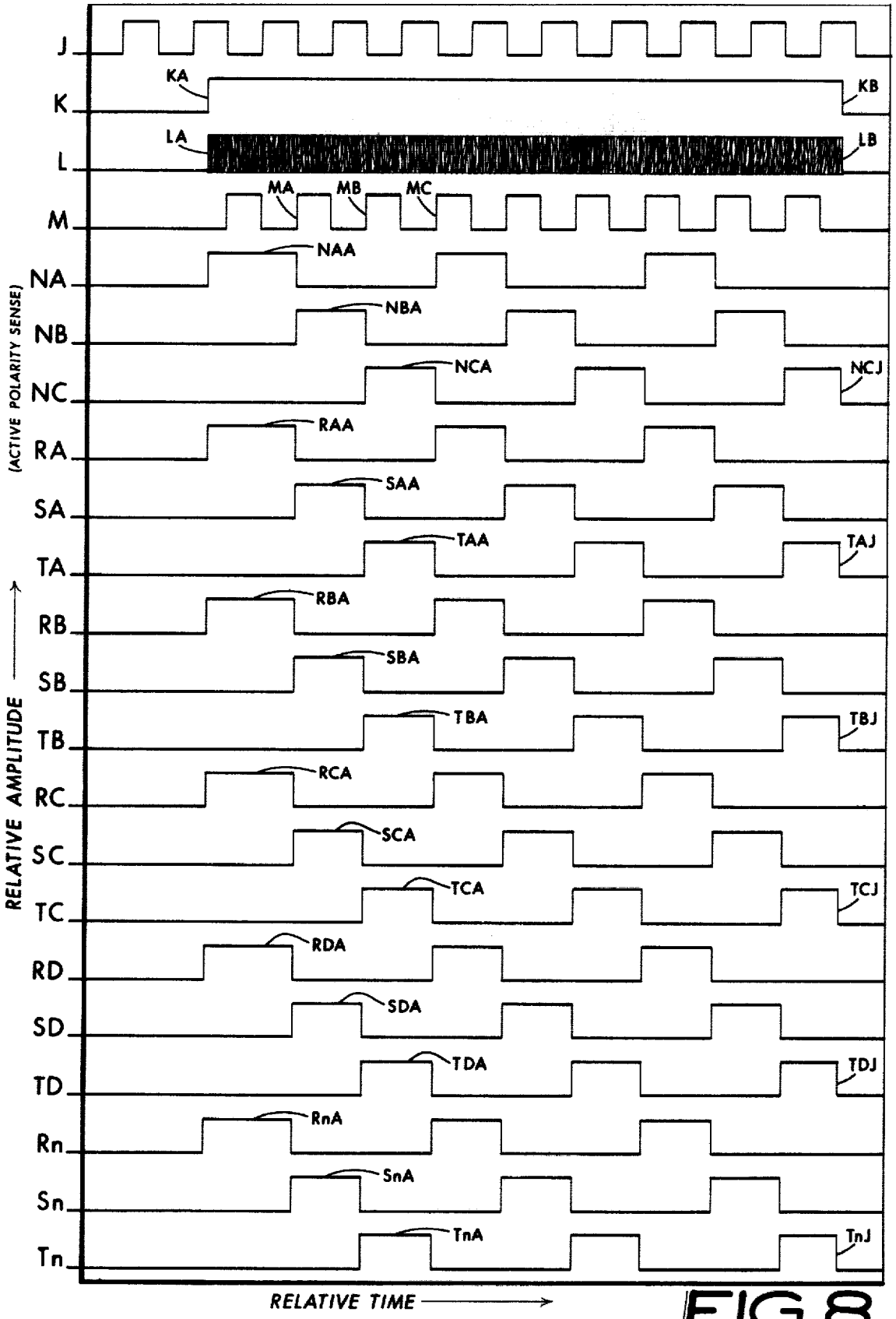
FIG. 8 Waveforms associated with circuits of FIG. 7.

The waveforms depicted in FIG. 8 serve to illustrate the typical signal conditions existing at the several key points in the circuit configured in FIG. 7. The sequencing clock signal J occurs with a periodicity between a few hertz and about a few hundred hertz; usually the rate is about 25 hertz. An enable input HIGH level K, shown to occur during the time period KA to KB acts to enable the flow of high frequency, e.g. several kilohertz, a.c. oscillator pulses L for the period LA to LB to the power supply amplifiers 115-1, 115-2, etc. At the same time, when signal K is HIGH sequencing signals M couple with the "divide-by-three" counter 140-1, 140-2. This action produces a recurrent sequential series of control pulses NA, NB, NC to be produced from the decoder arrangement. The effective result is shown as high voltage (corona level) pulses RA, RB, RC, RD and Rn which coincide with control pulse NA; pulses SA, SB, SC, SD and Sn which coincide with control pulse NB; and pulses TA, TB, TC, TD and Tn which coincide with control pulse NC. The pulses Rn, Sn, Tn represent any suitable number of additional corona electrodes which may be utilized in addition to the four sets depicted in FIG. 7. The sequential action which brings about the "sweeping" effect is clear from the staggered, e.g. 1-2-3 occurrence of the various pulses RAA, SAA, TAA in the first set; RBA, SBA, TBA in the second set; RCA, SCA, TCA in the third set; RDA, SDA, TDA in the fourth set; and RnA, SnA, TnA in any additional sets. Also shown is the abrupt cutoff of the control pulse NCJ and the corresponding corona pulses TAJ, TBJ, TCJ, TDJ, TnJ coincident with the DISABLE signal KB.

While the circuit of FIG. 7 does not particularly depict the inclusion of a relaxation period between pulses as shown by waveform G of FIG. 5, the practitioner shall find it obvious to implement some pause between the control pulses NAA, NBA, NCA to bring about this desirous effect. For example, a one shot flip-flop may couple between each decoder output 146-1, 146-2, 146-3 and the base of each control transistor 125-1, 125-2, 125-3 to bring about a several millisecond delay in the turn-on of each transistor when an active control pulse is effected.

The inclusion of current balancing resistors in series with each individual corona electrode in the arrangement of FIG. 7 may be preferable to assure the even distribution of current between each corona electrode. This variation serves to equalize the current distribution between two or more parallel connected electrodes.

The circuit of FIG. 7 is shown to provide three distinct corona pulse output signals in a fixed sequence. It is understood to be obvious that the same arrangement may be modified to provide but two alternant, back-and forth output signals. Conversely, the teaching may be extended to sequence through four or even more sequential steps.

Figure 9:
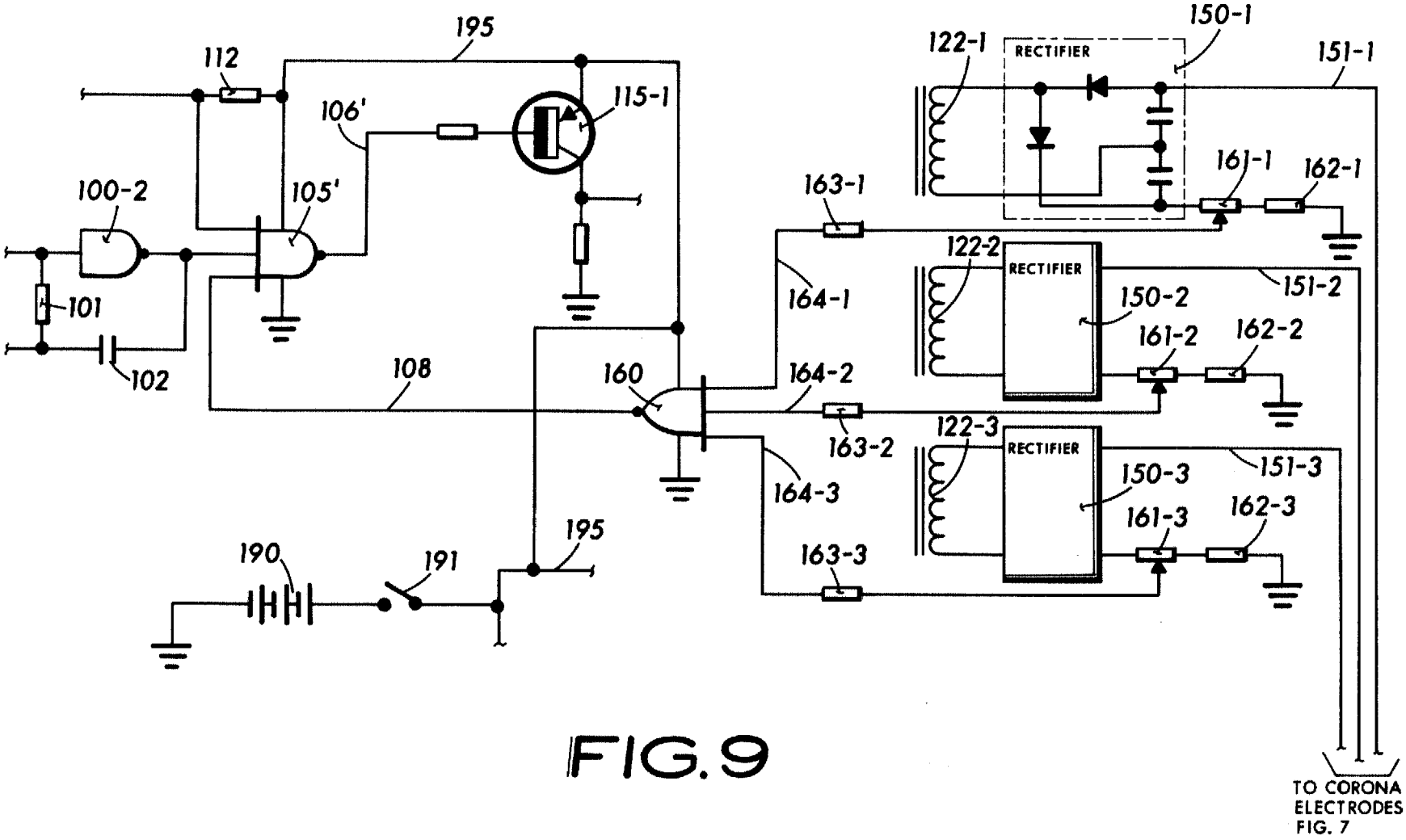
FIG. 9 Current control circuit for use with power supply of FIG. 7.

Feedback current stabilization of the individual corona fields is taught by FIG. 9, which serves to combine with FIG. 7 to provide separate acting control pulses for each corona channel. The ground return for each rectifier 150-1, 150-2, 150-3 is through respective resistors 161-1, 162-1; 161-2, 162-2; and 161-3, 162-3. The result is a positive voltage on the arm (tap) of each resistor 161-1, 161-2, 161-3 proportional to the momentary d.c. corona current flow in each corona circuit. These positive voltages are each coupled through protection resistors 163-1, 163-2, 163-3 to the individual inputs of NOR gate 160, say a CD4025AE. The result is that when the positive level on any one of the three gate inputs exceeds the $V_{IH}$ "input $\overline{\text{HIGH}}$ voltage" the output will go $\overline{\text{LOW}}$ inhibiting the NAND gate 105'. This stops further pulse flow to the transistor 115-1 and the associated transformer 122-1, 122-2, or 122-3. High voltage production will stop and the corona current will descend below the predetermined value, decreasing the voltage drop associated with the potentiometer until the voltage is below the aforesaid $V_{IH}$ value, resulting in a $\overline{\text{HIGH}}$ state on line 108. Pulses will resume, and the events will repeat indefinitely.

Figure 10:
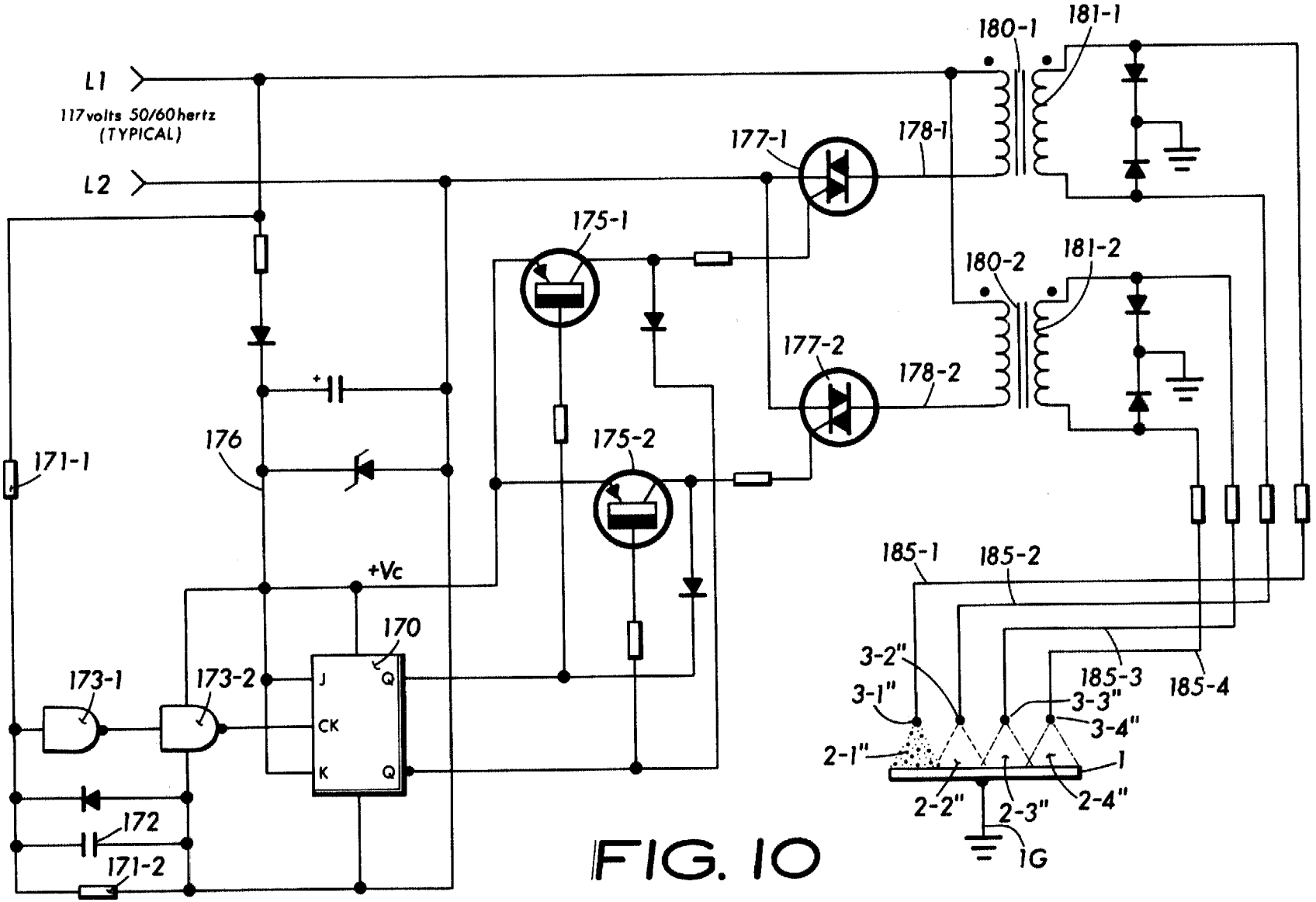
FIG. 10 Four corona electrode scanning power supply operated directly from a power line.

A preferred embodiment for a multicorona system based upon the teaching of FIG. 1 is shown in FIG. 10. The typical utility power alternating current couples with terminals L1, L2. L1 is coupled with one end of the primary on each transformer 180-1, 180-2. L2 couples through a thyristor (TRIAC) 177-1 to transformer 180-1, and thyristor 177-2 to transformer 180-2. The line L2 is also a "common" for the control circuits, thereby a diode receives some potential from line L1 which is rectified to provide a $+V_c$ value on line 176 of about 10 volts d.c. The a.c. waveform on line L1 relative to L2 couples through resistor 171-1, which together with despiking capacitor 172 and shunt resistor 171-2 provide a signal to the input of inverter 173-1, say a CD4069B. A second inverter 173-2 delivers the conditioned line frequency signal to the clock $\underline{\text{CK}}$ input of J-K flip-flop 170 operative as a "divide-by-two" function. The Q and $\overline{Q}$ outputs couple with gate drive transistors 175-1, 175-2 to alternately turn-on thyristor 177-1 or 177-2 for alternate, recurring cycles. The result is that during any two cycles, the first half-cycle, high voltage 185-1 will produce corona 2-1'' from electrode 3-1''; the alternant second half-cycle, high voltage 185-2 will produce corona 2-2'' from electrode 3-2''; the third half-cycle, high voltage 185-3 will produce corona 2-3'' from electrode 3-3''; and the fourth half-cycle, high voltage 185-4 will produce corona 2-4'' from electrode 3-4''. This sequential pattern repeats, producing a scanning of corona from left to right across the charge receptor 1 as herein depicted.

The step source signal 80 of FIG. 6, for example signal J in FIG. 7, may preferably be periodicity modulated (frequency modulated) with a pseudorandom signal pattern. The result is that the corona sequencing will occur in a like pseudorandom pattern. The effect is the breaking-up of any cyclic repetitiveness in the incidental laid-down charge irregularities which may persist and otherwise create a moire pattern effect or the like in the eventual electrophotographic image. In particular, this pseudorandom charge sequencing benefits overall corona charging systems wherein the charge receptor and the corona electrode group are moved relative to each other While specific embodiments of the invention have been illustrated and described herein, it is the very essence of the invention to teach a method for producing a uniform corona charge coupling of an electrophotographic member through the time sequential production of several corona fields which may spatially overlap. Therefore, it is realized that modifications and changes in the apparatus will occur to those skilled in the art which will suitably fulfill the method requirements. It is therefore to be understood that the appended claims are intended to cover all such modifications and changes as fall within the time spirit and scope of the invention.

What is claimed is:

1. Corona charging method whereby several overlapping electrically pulsed corona field regions act collectively to provide an effectively uniform charge current distribution throughout a charge receptor proximate therewith through the combination of:

a. establishing at least two coeffective electrically pulsed corona field regions which may adjacently overlap in space and which are at least efficaciously alternate in time.

2. Method of claim 1 whereby said coeffective electric corona field regions are established by:

a. producing a first electric corona field for a period of time;

b. producing at least a second electric corona field for an incongruous, effectively alternate period of time.

3. Corona charging apparatus including a plurality of corona-producing electrodes, effective for producing several electrically pulsed corona field regions which act collectively to provide an effectively uniform average current flow throughout a coactive charge receptor by establishing at least two coeffective electrically pulsed corona field regions between the said electrodes and the charge receptor which may adjacently overlap in space and which are at least efficaciously alternate in time, including in combination:

a. a plurality of corona field producing electrode means superposed with a charge receptor and having juxtapositional orientation therebetween which produces a predetermined amount of overlap of the adjacent corona fields;

b. a plurality of electric corona potential producing means, each effectively coupled with a separate said electrode means; and, c. a control means for sequencing the electric corona potential so that at least adjacent corona fields are produced in effective alternation.

4. Corona apparatus of claim 3 wherein two effective corona electrode means are provided, with the electric corona potential applied therebetween in alternation.

5. Corona apparatus of claim 3 wherein at least three effective corona electrode means are provided, with the electroc corona potential effectively applied to one electrode means at a time in cyclic sequential order.

6. Corona apparatus of claim 3 wherein said charge receptor is an electrophotographic medium.

7. Corona apparatus of claim 3 wherein said corona field producing electrode means each comprise a linear electrode usually in the form of a fine wire means about 0.025 to 0.15 millimeter diameter.

8. Corona apparatus of claim 3 wherein said corona field producing electrode means each comprise a conductive prickle means.

9. Corona charging apparatus including a plurality of corona field producing electrodes superposed proximate with a charge receptor, whereby at least individual adjacent said corona fields are functionally intimate with the usual deleterious result that electrostatic repulsion may coexist therebetween, whereby improvement is found in the combination of at least alternately sequencing the said electric corona producing potential coupled with at least the adjacent electrodes and repeating said sequencing in a rapid cyclic predetermined order between all the said electrodes.

10. Corona apparatus of claim 9 wherein said charge receptor is an electrophotographic medium.

11. Corona apparatus of claim 3 wherein said corona field is produced by direct current electric power flow which is current regulated.

12. Corona apparatus of claim 3 wherein each said corona field is effectively stabilized for about constant current flow generally between each said electrode means and the said charge receptor.

13. Corona apparatus of claim 9 wherein each said corona field is effectively stabilized for about constant current flow generally between each said electrode means and the said charge receptor.

14. Corona apparatus of claim 3 wherein said potential producing means comprises a first transformer having a high voltage secondary effectively coupled with a first said corona electrode means on the first half of the power cycle and coupled with a second said corona electrode means on the second half of the power cycle.

15. Corona apparatus of claim 14 wherein said potential producing means includes at least a second transformer effectively coupled with at least a third and a fourth corona electrode means for the sequential excitation thereof on alternate primary power half cycles; whereby further said first transformer is excited for the first alternate two half cycles and the subsequent, say second transformer is excited for the next alternate two half cycles of a continuance of alternating current power cycles.

16. Corona apparatus of claim 15 wherein said alternating current power cycles recur on the order of fifty to sixty hertz.

17. Corona apparatus of claim 3 wherein said potential producing means comprises at least two high frequency induction transformers, together with rectifier means each coupled with a separate said electrode means, wherein further each said transformer includes a primary having separate sequentially coupled excitation by a source of high frequency signal, whereby said sequential coupling is advanced through a predetermined pattern such that at least adjacent corona electrodes are not simultaneously excited.

18. Corona apparatus of claim 17 wherein said high frequency signal is between about 500 hertz and 100 kilohertz.

19. Corona apparatus of claim 17 wherein said sequential coupling effect recurs at a low repetition rate, on the order of about 10 to 100 hertz.

20. Corona apparatus of claim 17 wherein said sequential coupling is effected with a predetermined lapse of coupling between individual coupling step to provide relaxation of one corona field before the next corona field commences.

21. Corona apparatus of claim 17 wherein said rectifier means includes a voltage multiplier connection of diodes and capacitors.

22. Corona apparatus of claim 17 wherein the current flow effective with each separate electrode means is sampled and coupled with a level detector which coacts with the source of high frequency signal during each distinctively separate, albeit sequential, electrode excitation period so as to stabilize the effective d.c. current flow to each electrode at a predetermined level.

23. Corona apparatus of claim 22 wherein said level detector produces a first control signal when said instant d.c. current is below the predetermined level, whereby said first signal effectively couples with said source to enable the flow of signal pulses therefrom; and further produces a second control signal when said instant d.c. current exceeds the predetermined level, whereby said second signal effectively couples with said source to inhibit the flow of signal pulses therefrom.

24. Corona apparatus of claim 22 wherein said current flow is effectively sampled by a resistor coupled in series with the rectifier means ground return connection, said resistor providing a voltage level thereacross which is proportional to said current flow.

25. Corona apparatus of claim 3 particularly adapted to provide a voltage sequentially coupled with each corona electrode having a magnitude on the order of 5,000 to 12,000 volts with a current of about 50 to 3,000 microamperes.

26. Corona apparatus of claim 3 particularly adapted to excite three juxtaposed, substantially separate corona electrodes in a 1-2-3-1-2-3-etc., sequence, providing electrical simulation of scanning movement of the effective corona fields relative to the charge receptor.

27. Corona apparatus of claim 3 particularly adapted to excite four juxtaposed, substantially separate corona electrodes in a 1-2-3-4-1-2-3-4-etc., sequence, providing electrical simulation of scanning movement of the effective corona fields relative to the charge receptor.

28. Corona apparatus of claim 3 wherein the overlap between the corona field regions is predetemined to provide that the natural fall-off of off-axis corona current field inherent with one corona electrode is supplemented by the merging of the off axis corona current from the juxtaposed alternate corona field produced by another corona electrode, relative to the average unit area current in the charge receptor.

29. Method of claim 1 whereby said several coeffective electric corona field regions are produced substantially sequential in order with effectively pseudorandom time relationship therebetween.

30. Corona apparatus of claim 3 wherein said control means produces effectively pseudorandom sequencing in time for the electric corona potential.

31. Corona apparatus of claim 3 wherein said electrode means is translating in physical space and produces several efficacious physically alternate corona field regions which achieve pseudorandom irregularity in their electrical sequentiality.

32. Corona apparatus of claim 9 wherein said sequencing is pseudorandom in time recurrence.

33. Corona apparatus of claim 9 wherein said electrodes are translating relative to the said charge receptor; whereby incidental laid-down charge irregularities produced by said alternate sequencing may introduce moire effect; and said moire effect being minimized through pseudorandom time recurrence of said sequencing.

* * * * *